United States Patent [19]

Droubay

[11] 4,209,263

[45] Jun. 24, 1980

[54] STRUCTURE FOR REDUCED INK EVAPORATION

[75] Inventor: Michel Droubay, Chamonix, France

[73] Assignee: Waterman S. A., Paris, France

[21] Appl. No.: 872,103

[22] Filed: Jan. 25, 1978

[30] Foreign Application Priority Data

Jun. 20, 1977 [FR] France ..... 77 18833

[51] Int. Cl.[2] ..... B43K 5/00; B43K 8/02

[52] U.S. Cl. ..... 401/198; 401/199

[58] Field of Search ..... 401/196, 198, 199, 132, 401/133, 134, 135, 222, 223, 224, 241, 283, 23, 202, 207, 265, 292

[56] References Cited

U.S. PATENT DOCUMENTS

| | | | |
|---|---|---|---|
| 1,166,896 | 1/1916 | Garvey | 401/283 X |
| 2,676,349 | 4/1954 | Uosburg | 401/202 |
| 2,784,699 | 3/1957 | Sheaffer | 401/223 |
| 2,911,949 | 11/1959 | Beckwith | 401/212 |
| 2,957,452 | 10/1960 | Brannon | 401/223 X |
| 3,113,336 | 12/1963 | Langnickel | 401/199 X |
| 3,133,307 | 5/1964 | Steinberg et al. | 401/199 |
| 3,141,187 | 7/1964 | Simon, Jr. et al. | 401/199 |
| 3,355,239 | 11/1967 | Albrecht | 401/223 X |
| 3,418,056 | 12/1968 | Derbins | 401/199 |
| 3,446,563 | 5/1969 | Burnham | 401/202 X |
| 3,520,629 | 7/1970 | Otsuka | 401/199 |
| 3,572,954 | 3/1971 | Cheron | 401/199 X |
| 3,776,646 | 12/1973 | Bich | 401/199 |

FOREIGN PATENT DOCUMENTS

| | | | |
|---|---|---|---|
| 1461645 | 5/1969 | Fed. Rep. of Germany | 401/198 |
| 1809190 | 7/1969 | Fed. Rep. of Germany | 401/198 |
| 1485772 | 6/1967 | France | 401/199 |
| 1510830 | 1/1968 | France | 401/199 |
| 2079978 | 10/1971 | France | 401/198 |
| 2,216,215 | 11/1976 | France | 401/198 |
| 2,265,551 | 12/1977 | France | 401/198 |
| 51-21778 | of 1976 | Japan | 401/199 |

*Primary Examiner*—Paul T. Sewell
*Assistant Examiner*—Steven A. Bratlie
*Attorney, Agent, or Firm*—Kane, Dalsimer, Kane, Sullivan and Kurucz

[57] ABSTRACT

There is disclosed a writing unit better known as a refill for writing instruments, comprising a cap housing a cartridge composed of an ink accumulating capillary body, and a smaller diameter, greater capillary capacity ink feed member connected between the writing tip and the adjacent end of the capillary body. Air enters the case through a hole axially between the writing tip and the adjacent end of the capillary body and the forward end of a tubular cap sealingly engages the case, the tubular cap covers the portion of the feed member otherwise in contact with the atmosphere and the adjacent end of the capillary body so as to reduce evaporation of ink from capillary parts.

4 Claims, 5 Drawing Figures

STRUCTURE FOR REDUCED INK EVAPORATION

BACKGROUND OF THE INVENTION

The present invention relates generally to writing instruments and more particularly to liquid ink writing units or refills therefor.

Liquid ink writing units are used comprising a cartridge with a capillary body charged with ink and an ink feed member having increasing capillarity rate interposed between the cartridge and a writing tip which is either the end of the ink feed member or a ballpoint.

In known writing units the ink accumulating capillary body of the cartridge is in communication with the atmosphere through its lower or front end so that the ink evaporates relatively quickly.

Further, the pressure or impacts which the writing instrument undergoes during use, sometimes causes the displacement or deformation of the parts of the writing unit which may adversely affect the operation thereof.

SUMMARY OF THE INVENTION

An object of the invention is the provision of a writing unit which overcomes the foregoing drawbacks.

According to the invention there is provided a writing unit comprising a connecting member between the cartridge and the ink feed member for the writing tip, a tubular cap which surrounds part of the ink feed member exposed to the air and covers the front end of the cartridge thereby reducing the surface of the liquid charged capillary network in contact with the air.

According to an embodiment the tubular cap comprises a positive abutment for the ink feed member the outer end of which bears writing pressure.

Another feature of the present invention provides that the forward end of the cap is sealingly applied against the opposite face of the cartridge.

The description which follows, given by way of example, makes reference to the accompanying drawing.

DESCRIPTION OF THE PREFERRED EMBODIMENTS

Figures 1, 2, 3, 4, 5:
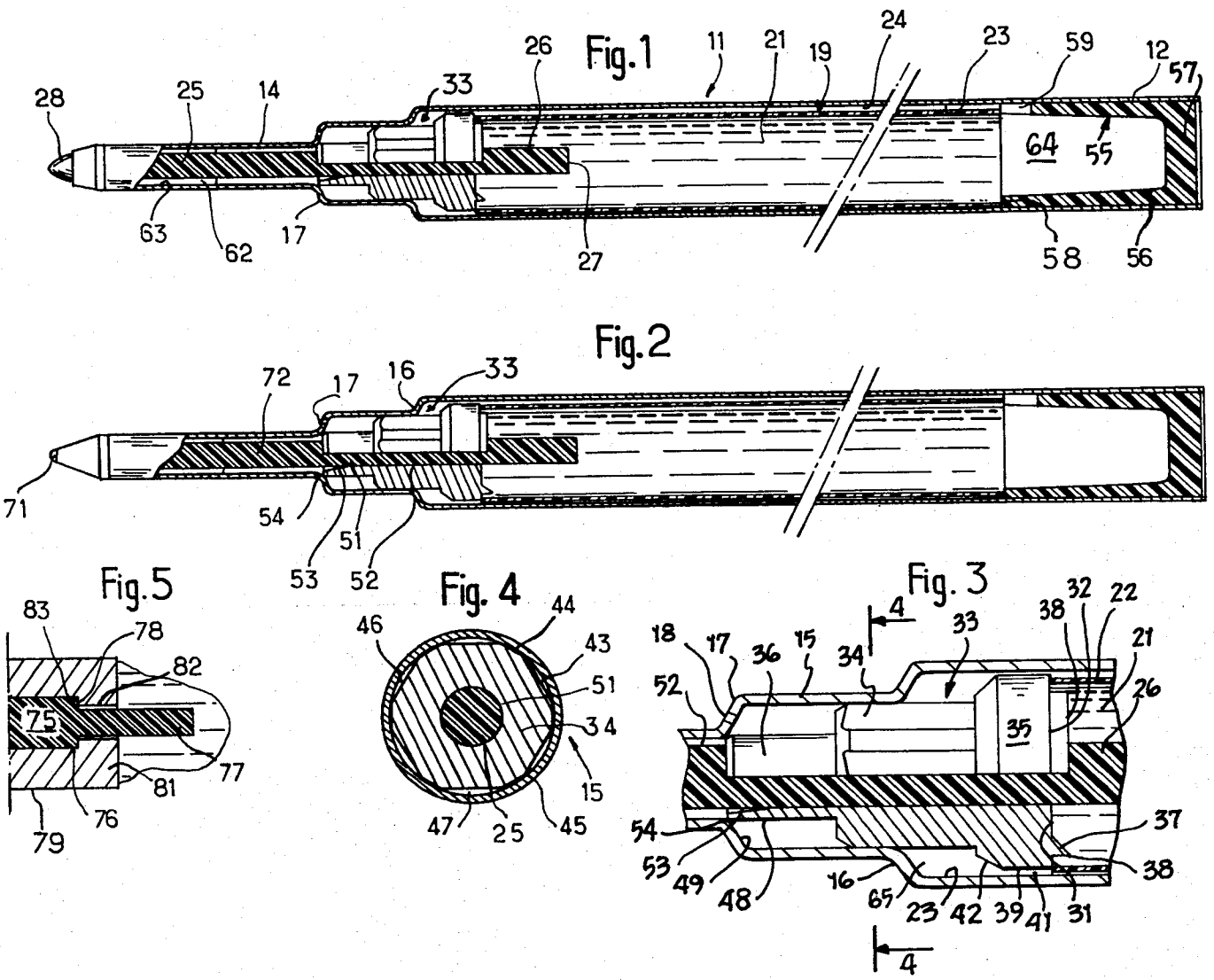
FIG. 1 is a view partly in elevation, with portions broken away, and partly in longitudinal section, of a first writing unit embodying the present invention.
FIG. 2 is a view similar to FIG. 1, for another embodiment.
FIG. 3 is a view, on an enlarged scale, of a part of the embodiments of FIGS. 1 and 2.
FIG. 4 is a transverse cross-section taken on the line 4—4 in FIG. 3.
FIG. 5 is a diagrammatical view of a detail of another embodiment according to the invention.

The writing unit, often known as a refill, comprises a cylindrical tubular body or case 11 of rigid plastic material or noncorrodible metal or having a noncorrodible surface, the rear part 12 is open at its end 13 and the front part 14, of smaller diameter, is connected to the rear part 12 by an intermediate part 15 of diameter intermediate that of the rear part 12 and the front part 14, substantially frustoconical shoulders 16 and 17 interconnecting the rear and front parts with the intermediate part. An air hole 18 is provided in the shoulder 17.

The rear part 12 houses a cartridge 19, sometimes referred to as a tampon, composed of an ink accumulating capillary body or network 21, with intercommunicating pores, housed in a liner 22. The diameter of the liner 22 is slightly less than that of the inner surface 23 of the tubular body of the cartridge so as to define a gap 24 between the liner 22 and the tubular body 11.

The ink accumulating capillary body 21 of cylindrical shape is in contact at its forward end with the rear part of an elongated ink feed member comprising, in the embodiment of FIGS. 1 and 3, a stem 25 of material having a greater capillarity rate and a greater cohesiveness and a smaller diameter than that of the capillary body 21, the stem itself being sometimes referred to as the "felt." The rear part of the stem 25 is embedded in the forward part of the capillary body 21 and in contact therewith along the portion 26 of its sidewall and through its rear end face 27. The stem 25 protrudes inside the small diameter front part 14 and its free end 28 (flat, conical or bevelled) opposite its rear end face 27 defines the writing tip of the unit or refill. The stem 25 may be composed not only of felt or fibrous material but also of conglomerate or extruded plastic material (having capillary tubes in its central core), or gumlike plastic material, or even sintered metal or porous ceramic.

The tip 28 may be formed in one piece with the stem or on the contrary form a distinct part therefrom.

The annular forward face 31 of the capillary body 21 is in contact with practically the totality of the annular rear face 32 of a tubular cap 33 which has a body portion 34 from which a rear shoulder 35 and a forward sleeve 36 protrude.

The annular rear face 32 of the cap 33 is provided in the vicinity of its periphery with an annular projection 37 with a flank or edge 38 which penetrates into the capillary body 21. The shoulder 35 has a cylindrical outer surface 39 defining a gap 41 with the inner surface 23 of the tubular body or case 11. A bevelled shoulder 42 connects the cylindrical outer surface 39 to the body portion 34.

The outer surface of the body portion 34 is prism shaped, defined by planar faces 43, and its cross section is substantially hexagonal, the planar faces 43, however, being interconnected by narrow faces 44. The edges 45 of the prism shaped body portion 34 are in contact with the inner surface 46 of the intermediate part 15 of the tubular body or case, so that circular segmental gaps 47 are formed between the inner surface 46 and the planar faces 43 defining the prism.

The body portion 34 is in contact with the inner surface 46 only along a portion of the length thereof and the forward sleeve 36 sealingly abuts at its forward end 48 against the inner surface 49 of the frustoconical shoulder 17 between the intermediate part 15 and the small diameter front part 14.

The inner surface 51 of the cap 33 is cylindrical over the major part of its length and is in contact with the outer surface 52 of the stem 25, but its forward end flares into a frustoconical surface 53 connected to a bevelled bearing surface 54 of the forward end of the cap 33 abutting against the inner surface 49 of the frustoconical shoulder 17.

The cap 33 diminishes the evaporation of liquid ink.

To achieve the same result other forms of caps may be employed: an alternative cap may be, for example, generally frustoconical, grooved, or cylindrical.

The cap 33 is inserted into the tubular body 11 through the rear end opening thereof until the bevelled bearing surface 54 abuts against retaining wall defined by the inner surface 49. The cartridge 19 is then also inserted through the rear end of the tubular body 11, this cartridge may or may not be prefilled; in the latter case the cartridge is filled after insertion by a syringe (not shown). A tubular stopper or plug 55 is then forced into the end 13 of the tubular body 11. The stopper or plug 55 comprises a skirt 56 closed at its rear end by an end wall 57 and is open at its forward end. The forward edge 58 of the plug 56 has at least one notch 59. The chamber 64 thus defined permits the recondensation of ink on the cartridge 19.

The feeding and writing portions defined by parts 25–28 are then mounted by inserting them in the front part 14 of the tubular body 11.

The forward face 31 of the capillary body 21 is not in communication with the atmosphere, but is protected by the rear face 32 of cap 33. Air present inside the annular gap 62 between the outer surface of the stem 25 and the inner surface 63 of the front part 14 of the tubular body or case 11 is confined to this gap, owing to the fluidtight seal effected by the abutment of the bevelled surface 54 with the inner surface of the shoulder 17. All of the outer surface of the stem covered by the inner surface of the tubular cap 33 is out of contact with the atmosphere.

The evaporation of liquid ink contained in the capillary body 21 and the stem defining the ink feed to the writing tip is thus minimized.

The atmospheric pressure in the rear chamber 64 inside the hollow plug 55 is maintained by air which enters through the aperture 18, flows in the gaps 47 between the tubular cap 33 and the tubular body 11, reaches the annular compartment 65 included between the cap 33 and the large diameter rear part of the tubular body, flows in the gap 24 and reaches the chamber 64 through the notch (or notches) 59 in the plug 55.

In the embodiment illustrated in FIG. 2, the writing tip is a ballpoint 71 of noncorrodible material (e.g. steel, carbide, glass, synthetic ruby or saphire, ceramic) mounted in a metal or plastic part and feed in a manner known per se from the ink feed member 72, which, like stem 25, is made of fiber material, conglomerate material, gumlike plastic material or the like.

The feed may also be provided by a rigid tongue defining a capillary space by which the ink is fed between the capillary body 21 of the cartridge and the writing tip.

In the embodiment shown schematically in FIG. 5, the ink feed member 75 between the capillary body 21 and the writing tip comprises, extending its body 76, tail portion 77 of smaller diameter forming a shoulder 78 and the tubular cap 79 has a rear inwardly turned flange 81 having a central opening 82 for accommodating the tail portion 77 and the annular forward face 83 serves as an abutment against the shoulder 78 so as to produce the reaction to the writing pressure which is exerted at the other end of the ink feed member 75.

What is claimed is:

1. A writing unit comprising: a case; a writing point forwardly protruding from said case and lodged in said case; an ink capillary accumulating element in said case and having a forward end; an ink capillary feed member having a forward portion in contact with said writing point and a rearward portion in contact with said forward end of said ink capillary accumulating element, said feed member positioned within said case such that a gap exists between the outer surface of said feed member and the inner surface of said case; a cap member sealingly bearing onto the forward end of said ink accumulating element; a through hole formed in said cap member, said rearward portion of said feed member fitted into said through hole, and said through hole widening forwardly in said cap member to allow easy insertion of said feed member, said cap member forming a zone of sealing contact with the inner surface of said case; and a venting aperture formed in said case rearwardly of said zone of sealing contact between said cap member and the inner surface of said case.

2. A writing unit according to claim 1, wherein said sealing zone is formed on a shoulder of said case.

3. A writing unit according to claim 2, wherein the shoulder is of frustoconical shape.

4. A writing unit according to claim 1, wherein said cap member has a middle portion of prismatic outer configuration facing a section of said case of cylindrical configuration located rearwardly of said venting aperture.

* * * * *